US008245371B2

(12) United States Patent
Chen

(10) Patent No.: US 8,245,371 B2
(45) Date of Patent: Aug. 21, 2012

(54) STRING SECURING DEVICE

(76) Inventor: Chin Chu Chen, Taiching Hsien (TW)

( * ) Notice: Subject to any disclaimer, the term of this patent is extended or adjusted under 35 U.S.C. 154(b) by 122 days.

(21) Appl. No.: 12/385,173

(22) Filed: Apr. 1, 2009

(65) Prior Publication Data

US 2010/0251524 A1 Oct. 7, 2010

(51) Int. Cl.
*A43C 7/00* (2006.01)

(52) U.S. Cl. ..... 24/712.9; 24/68 B; 24/68 SK; 24/712; 24/712.1; 24/713.2; 242/378; 242/378.1; 242/378.2; 242/378.3; 242/388

(58) Field of Classification Search ..... 2/417, 418; 24/16 R, 20 TT, 68 B, 68 R, 68 SK, 115 R, 24/712, 712.1, 712.2, 712.7, 712.9, 713.2, 24/715.3, 909; 242/378, 378.1–378.4, 388, 242/388.1–388.4; 254/222, 223, 238, 239
See application file for complete search history.

(56) References Cited

U.S. PATENT DOCUMENTS

| | | | | |
|---|---|---|---|---|
| 1,165,816 | A * | 12/1915 | Tichenor | 24/18 |
| 3,214,809 | A * | 11/1965 | Zahnor | 24/68 B |
| 4,433,456 | A * | 2/1984 | Baggio | 24/68 SK |
| 4,633,599 | A * | 1/1987 | Morell et al. | 242/388.1 |
| 5,425,161 | A * | 6/1995 | Schoch | 24/68 SK |
| 5,722,266 | A * | 3/1998 | Yeager et al. | 70/57 |
| 6,015,110 | A * | 1/2000 | Lai | 242/388.1 |
| 6,658,765 | B2 * | 12/2003 | Liu | 36/50.1 |
| 7,076,843 | B2 * | 7/2006 | Sakabayashi | 24/68 SK |
| 7,174,575 | B1 * | 2/2007 | Scherer | 2/418 |
| 7,292,149 | B2 * | 11/2007 | Yasur et al. | 340/573.1 |
| 7,367,522 | B2 * | 5/2008 | Chen | 242/378.1 |
| 7,497,100 | B2 * | 3/2009 | Fawcett et al. | 70/57 |
| 7,497,101 | B2 * | 3/2009 | Fawcett et al. | 70/57 |
| 7,546,667 | B2 * | 6/2009 | Yang | 24/614 |
| 7,584,528 | B2 * | 9/2009 | Hu | 24/68 SK |
| 7,617,573 | B2 * | 11/2009 | Chen | 24/68 SK |
| 7,685,850 | B2 * | 3/2010 | Nilsson | 70/18 |
| 7,815,025 | B2 * | 10/2010 | Chen et al. | 191/12 R |
| 2006/0053845 | A1 * | 3/2006 | Benda et al. | 70/18 |
| 2007/0094851 | A1 * | 5/2007 | Yang | 24/115 R |
| 2008/0172848 | A1 * | 7/2008 | Chen | 24/68 SK |
| 2009/0039191 | A1 * | 2/2009 | Yen | 242/378.2 |
| 2010/0139057 | A1 * | 6/2010 | Soderberg et al. | 24/68 R |

* cited by examiner

*Primary Examiner* — Robert Sandy
*Assistant Examiner* — Tyler Johnson

(57) ABSTRACT

A string securing device includes a base having a central post extending centrally therefrom. A shaft extends through the passage in the central post so as to be connected to the cap mounted to the base by a bolt which extends through the cap from a top of the cap. A ring and a spool are located between the base and the cap, wherein the spool is rotated with the cap by engagement of first and second teeth on the spool and the cap respectively. The ring has multiple ratchet teeth which are removably engaged with third teeth on the cap so as to allow the cap to rotate in one direction. The ring includes flexible members which are deformed to lower the ring and provides straight and upward force to the cap.

9 Claims, 11 Drawing Sheets

STRING SECURING DEVICE

FIELD OF THE INVENTION

The present invention relates to a securing device, and more particularly, to a string securing device that is operated smoothly.

BACKGROUND OF THE INVENTION

A conventional string/shoelace securing device is shown in FIGS. 10 to 13, and generally includes a base 61, two positioning pins 62, a spool 63, a ring 64, a cap 65 and a wire or shoelace. The base 61 includes a connection plate 611 which is fixed to a shoe (not shown) and the spool 63 is rotatably mounted to the central post on the base 61. A bolt 612 extends through the central post from the underside of the base 61 and is connected to the post 653 on the underside of the cap 65. The two positioning pins 62 are cooperated with two springs 622 and inserted into reception holes in the base 61 and each positioning pin 62 has an inclined surface 621 on a top thereof. The ring 64 is mounted on the spool 63 to position the spool 63 which further includes first teeth 631 which are engaged with second teeth 651 defined in the underside of the cap 65. The underside of the cover 5 further includes third teeth 652 which are cooperated with the inclined surfaces 621 to allow the cap 65 to rotate one direction to rotate the spool 63. The shoelace 66 extends through the skirt of the base 61 and wraps the spool 63, two ends of the shoelace 66 are fixed to the spool 63. When tightening the shoelace 66, the user simply rotates the cap 65 to rotate the spool 63 to fasten the shoelace 66. When releasing the shoelace 66, the cap 65 is pulled away from the base 61 to disengage the first teeth 631 from the second teeth 651, and the third teeth 652 from the inclined surfaces 621, the shoelace 66 can be pulled and loosened.

Another conventional string/shoelace securing device is shown in FIGS. 14 and 15, and generally includes a base 71 having first teeth 711 defined in a top thereof, a spool 72 having second teeth 721, a spring 74, a cap 73 which is rotatably mounted to the base 71 by a bolt 75. The spool 72 is located between the base 71 and the cap 73 and the second teeth 721 are engaged with third teeth 731 defined in the underside of the cap 73. The cap 73 further includes four flexible arms 732 located at the underside thereof and each arm 732 has one end fixed to the cap 73 and the other end is a free end which has a claw 733 which is removably engaged with the first teeth 711. By rotating the cap 73, the spool 72 is and rotated to tighten the shoelace. By lifting the cap 73, the shoelace can be loosened.

For the first conventional shoelace securing device, the two positioning pins 62 are positioned by the ring 64 and the positioning pins 62 compress the springs 622. This arrangement makes the two positioning pins 62 do not compress the springs 622 evenly which pushes the positioning pins 62 by different forces such that the rotation of the cap 65 may not be smooth as desired. Besides, the installation of the springs 622 into the reception holes requires time. Furthermore, because the bolt 612 extends from the underside of the base 61 to connect the cap 65, so that the whole set of the device has to be separated when a part between the base 61 and the cap 65 needs to be replaced.

For the second conventional shoelace securing device, because the arms 732 has one end fixed to the cap 73 so that the force reacts from the first teeth 711 has to be transfer a distance to the end that is fixed to the cap 73. This may result in uneven biasing forces to the arms 732 and may have the same problem as the first conventional securing device.

The present invention intends to provide an improved securing device for tightening string, strap, or shoelace, wherein the spool is pushed straightly and upward to cooperate with the cap, the forces between the cap and the spool are even so that the operation of the cap is more reliable and smooth.

SUMMARY OF THE INVENTION

The present invention relates to a string securing device which comprises a base having a skirt extending from a top thereof so as to define a space. A central post extends centrally from an inner end of the space and has a passage defined axially therethrough. A shaft extends through the passage of the central post and is connected to a cap mounted to the base. A ring is located within the space defined by the skirt and includes multiple ratchet teeth on a top thereof and multiple flexible members are connected to an underside of the ring. A spool has an annular groove in which the string wraps the spool and a through hole is defined axially through the spool so that the central post extends through the through hole. Multiple first teeth extend radially from a top tubular portion of the spool and are engaged with multiple second teeth defined in an underside of the cap. The underside of the cap further includes multiple third teeth which are removably engaged with the ratchet teeth on the ring.

The primary object of the present invention is to provide a string securing device which includes simple structure and the cap is operated smoothly.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
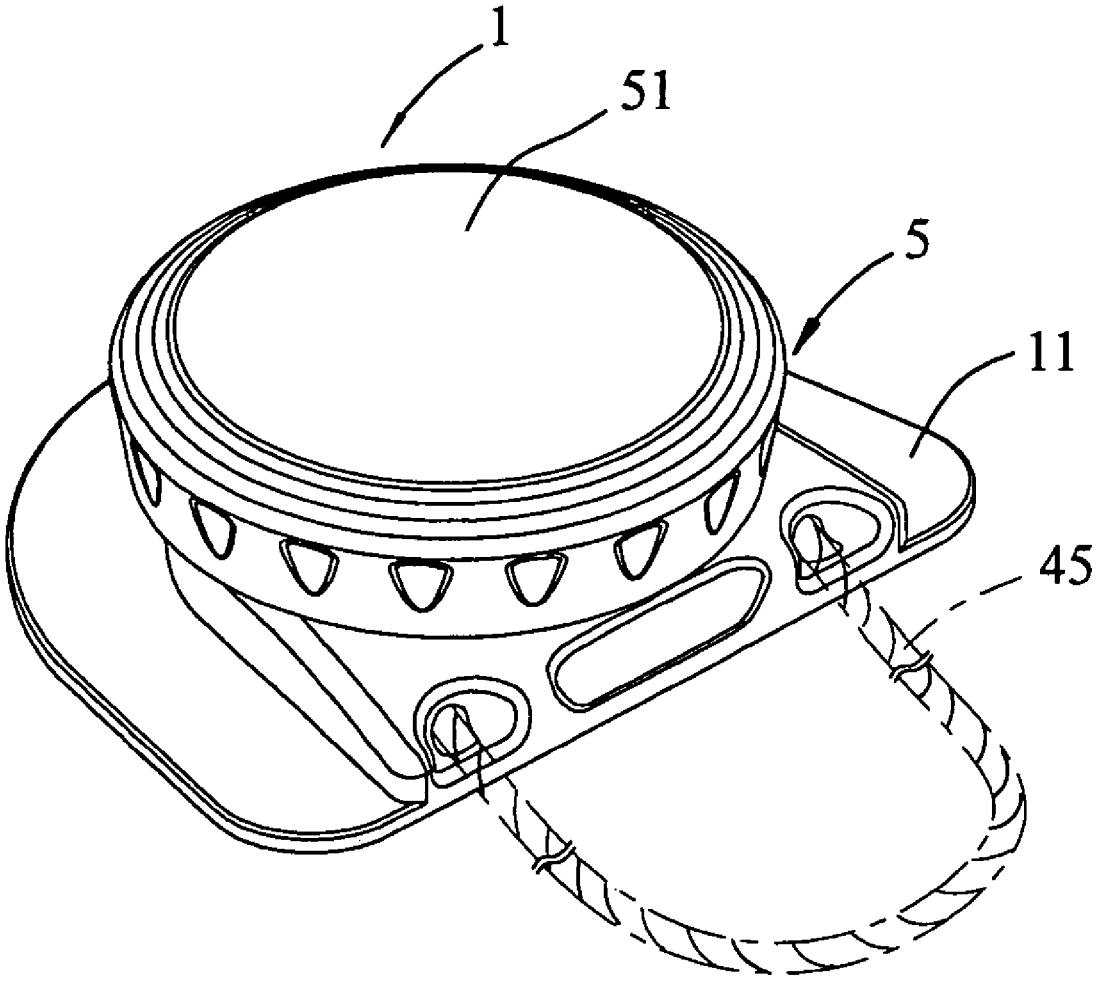
FIG. 1 is a perspective view to show the string securing device of the present invention.
Figure 2:
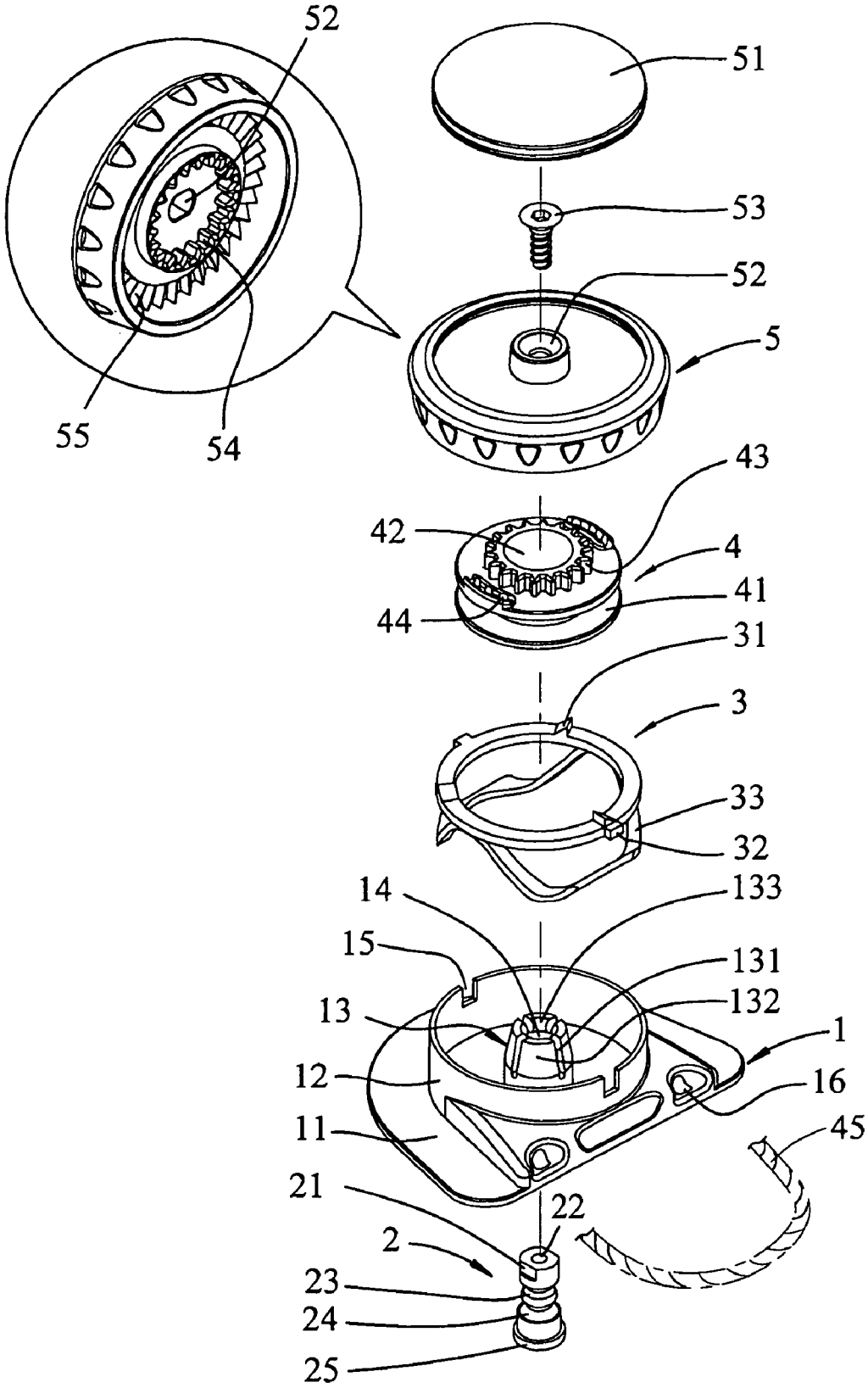
FIG. 2 is an exploded view to show the string securing device of the present invention.
Figure 3:
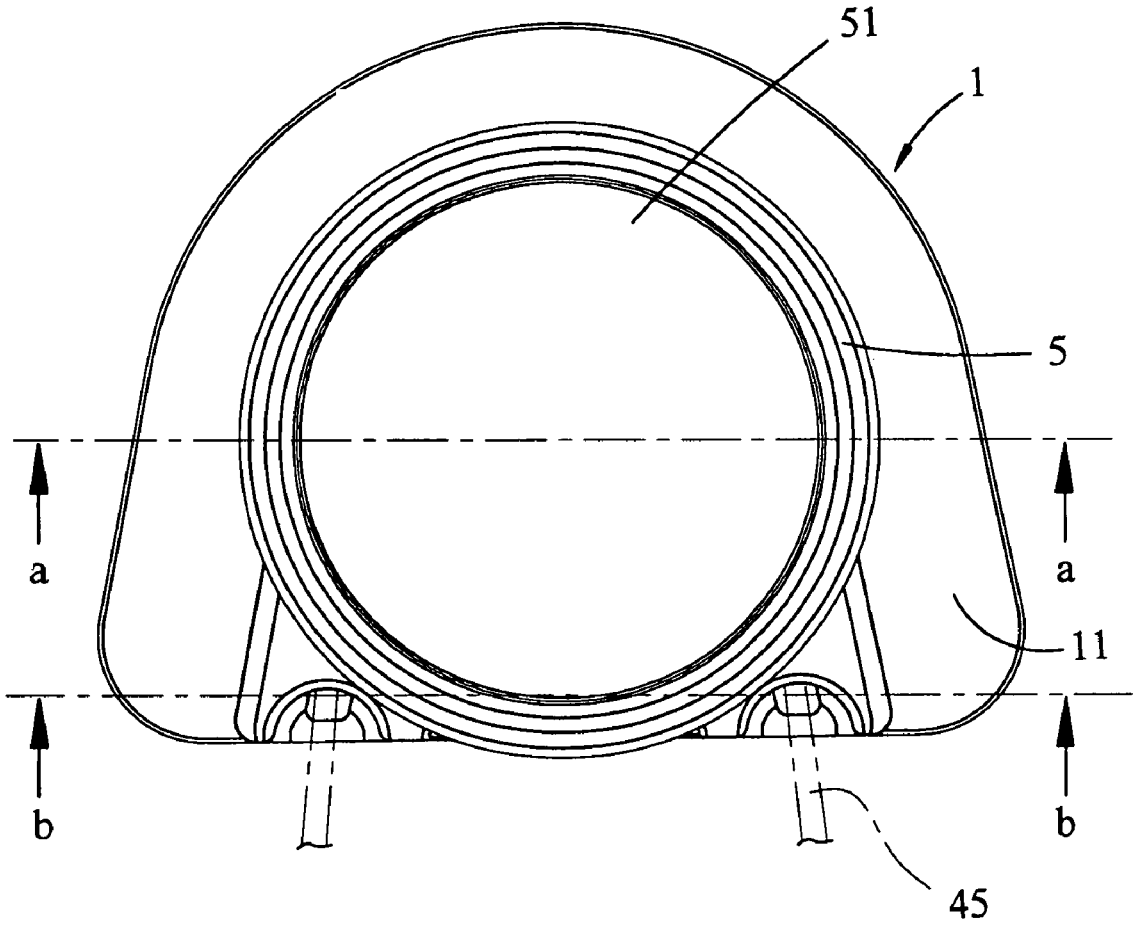
FIG. 3 is a top view of the string securing device of the present invention.

Referring to FIGS. 1 to 5, the string securing device of the present invention comprises a base 1 having a connection plate 11 so as to be fixed to an object such as a bag, helmet or shoe (not shown) and a skirt 12 extends from a top of the connection plate 11. The skirt 12 defines a space and a central post 13 extends centrally from an inner end of the space. A passage 14 is defined axially through the central post 13. The central post 13 includes multiple plates 132 and multiple axial slits 131 are located between the plates 132. Each plate 132 has a lip 133 extending inward from a top thereof and a stepped shoulder 134 is defined in an inner periphery of the passage 14. The skirt 12 includes two notches 15 defined in a top thereof and two holes 16 are defined in the base 1 so that the string 45 or shoelace extends into the holes 16.

A shaft 2 extends through the passage 14 of the central post 13 and a connection end 21 is located on a top end of the shaft 2. A first groove 23 and a second groove 24 are defined in an outer periphery of the shaft 2, the second groove 24 is located beneath the first groove 23. The shaft 2 further includes a positioning hole 22 defined in the connection end 21 on the top end thereof and a flange 25 extends radially outward from a bottom end of the shaft 2.

A ring 3 has multiple ratchet teeth 31 extending from a top thereof and multiple flexible members 33 are connected to an underside of the ring 3. The flexible members 33 are shaped to be deformed evenly so as to store a straight and upward force. The ring 3 is located within the space defined by the skirt 12. Two blocks 32 extend radially from an outer periphery of the ring 3 and are engaged with the notches 15 of the skirt 12.

A spool 4 has an annular groove 41 and the string 45 wraps around the spool 4, the two ends of the string 45 are fixed with the fixing holes 44 defined in the spool 4. A through hole 42 is defined axially through the spool 4 and multiple first teeth 43 extend radially from a top tubular portion of the spool 4. The spool 4 is mounted to the central post 13 which extends through the through hole 42.

A cap 5 is connected to the shaft 2 and mounted to the base 1. The cap 5 includes a central hole 52 and a bolt 53 extends through the central hole 52 from a top of the cap 5 and is connected to the positioning hole 22 of the shaft 2. Multiple second teeth 54 are defined in an underside of the cap 5 and engaged with the first teeth 43 of the spool 4. Multiple third teeth 55 are defined in the underside of the cap 5 and removably engaged with the ratchet teeth 31 on the ring 3. A cover 51 is mounted to the top of the cap 5 to hide the bolt 53.

When rotating the cap 5, the engagement of the first and second teeth 43, 54 drives the spool 4 to rotate so as to tighten the string 45. In the meanwhile, the third teeth 55 move over the ratchet teeth 31 which are lowered by compressing the flexible members 33, so that the cap 5 is able to rotate in one direction and does not return. It is noted that the deformation of the flexible members 33 provides straight and upward force to cooperate the ratchet teeth 31 with the third teeth 55 so that the rotation of the cap 4 is smooth.

Figure 4:
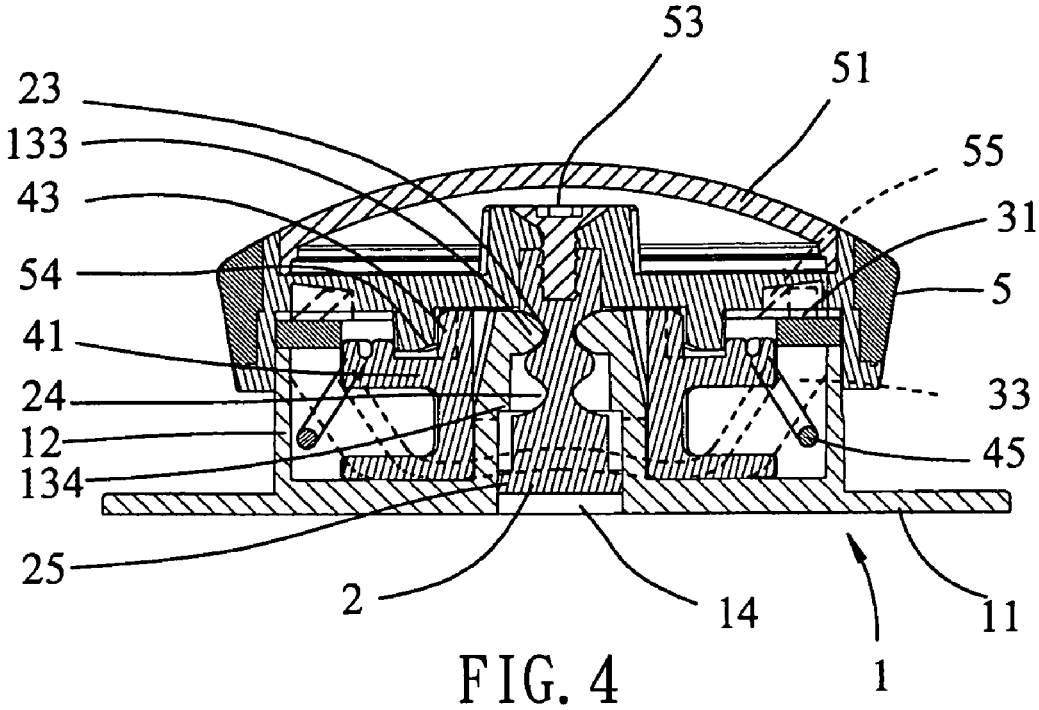
FIG. 4 is a side cross sectional view, taken along line a-a in FIG. 3, wherein the cap is not pulled upward.
Figure 5:
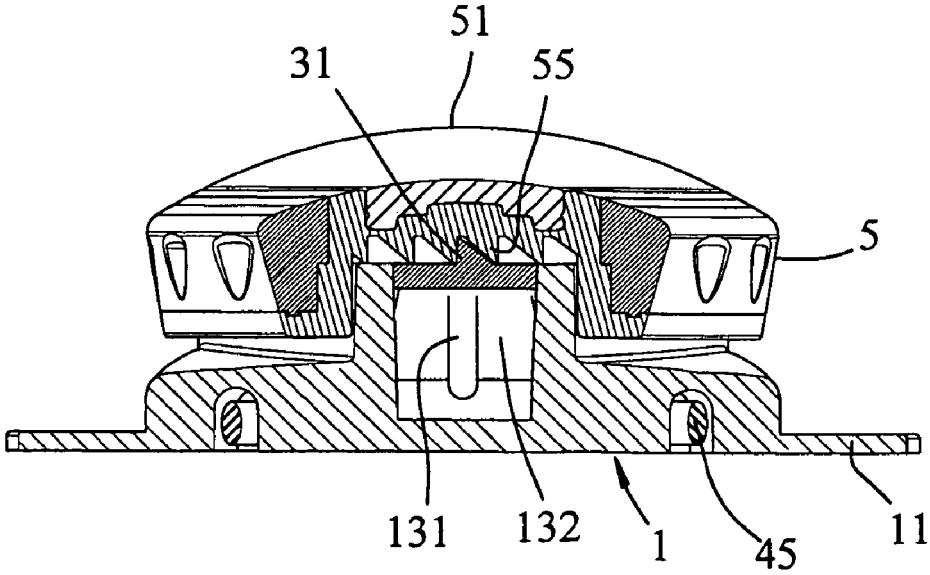
FIG. 5 is a side cross sectional view, taken along line b-b in FIG. 3, wherein the cap is not pulled upward.
Figure 6:
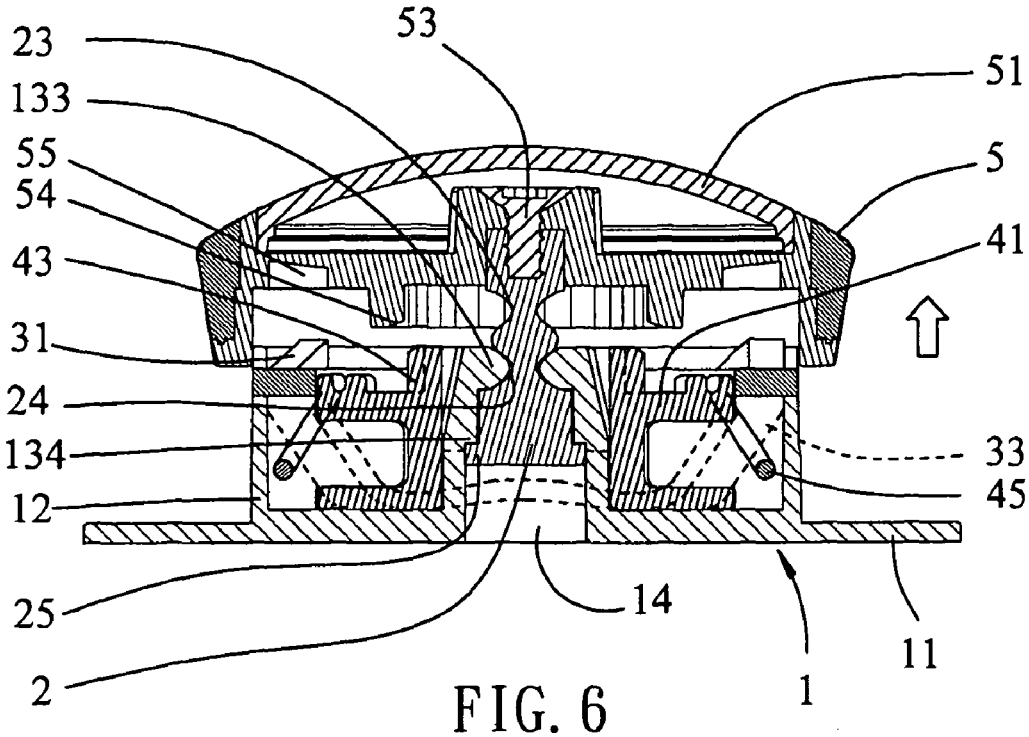
FIG. 6 is a side cross sectional view, taken along line a-a in FIG. 3, wherein the cap is pulled upward.
Figure 7:
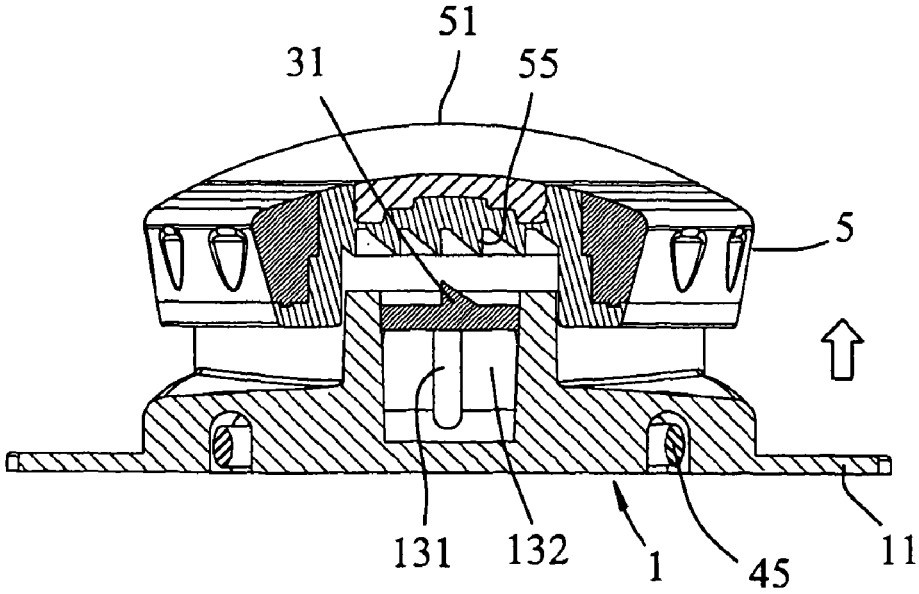
FIG. 7 is a side cross sectional view, taken along line b-b in FIG. 3, wherein the cap is pulled upward.

As shown in FIGS. 6 and 7, when the user wants to loosen the string 45, the cap 5 is lifted and the first and second teeth 43, 54 are separated, and the ratchet teeth 31 are separated from the third teeth 55. The spool 4 now can be freely rotated so that the string 45 can be loosened easily. When the cap 5 is not yet pulled upward, the lips 133 are engaged with the first groove 23 as shown in FIG. 4. When loosening the string by lifting the cap 5, the lips 133 are removed from the first groove 23 and engaged with the second groove 24 as shown in FIG. 6. The flange 25 is stopped by the shoulder 134 to prevent the shaft 2 from disengaging from the passage 14.

Figure 8:
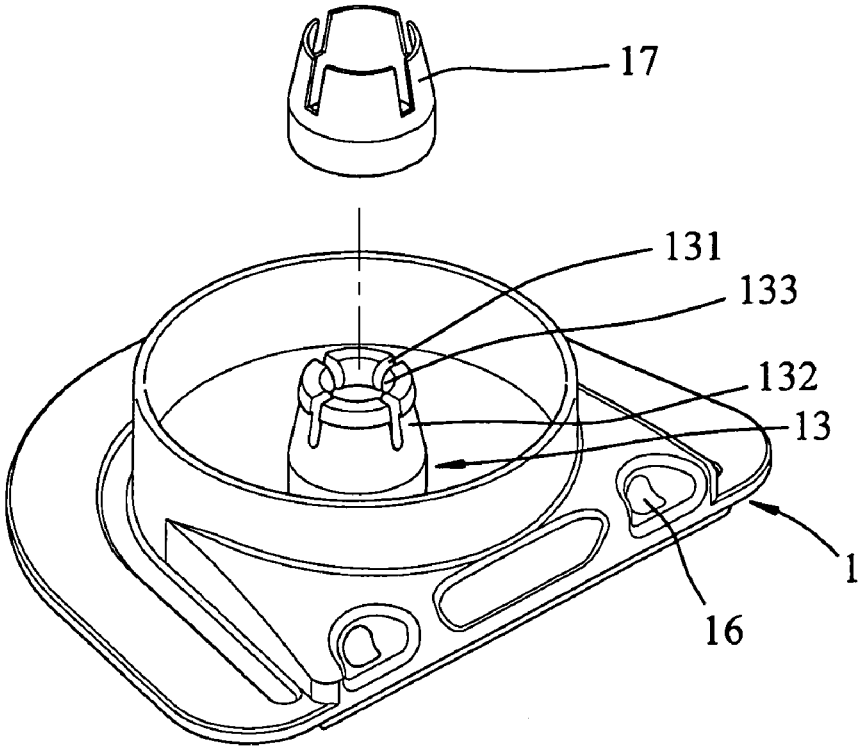
FIG. 8 is an exploded view to show that a collar is to be mounted to the central post of the base.
Figure 9:
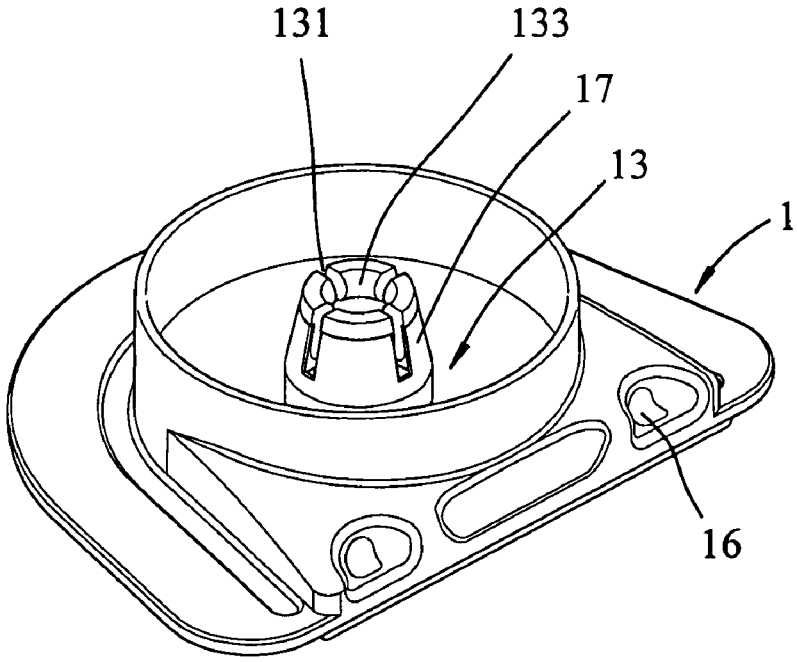
FIG. 9 shows that a collar is mounted to the central post of the base.
Figure 10:
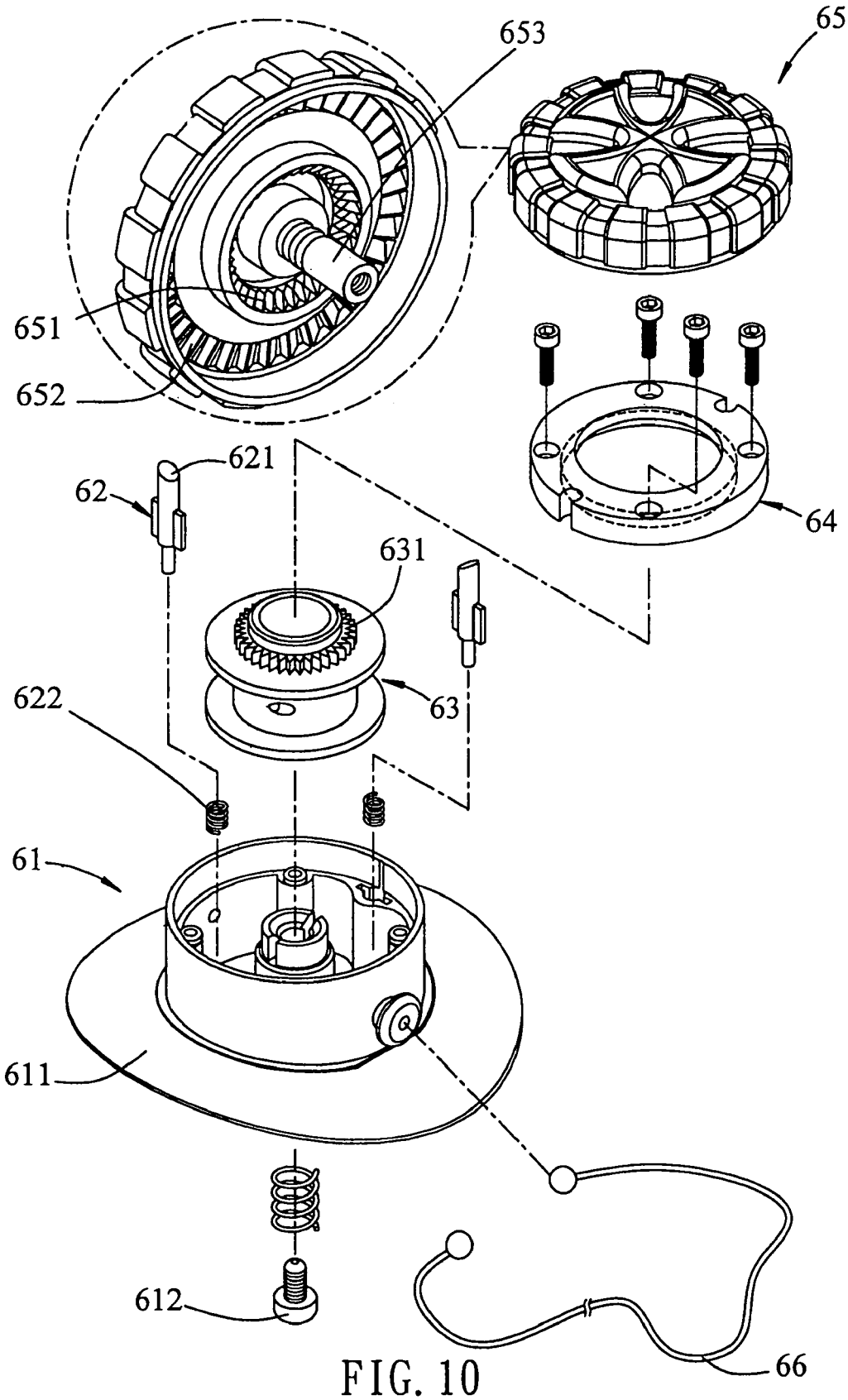
FIG. 10 PRIOR ART
FIG. 10 is an exploded view to show a first conventional shoelace securing device.
Figure 11:
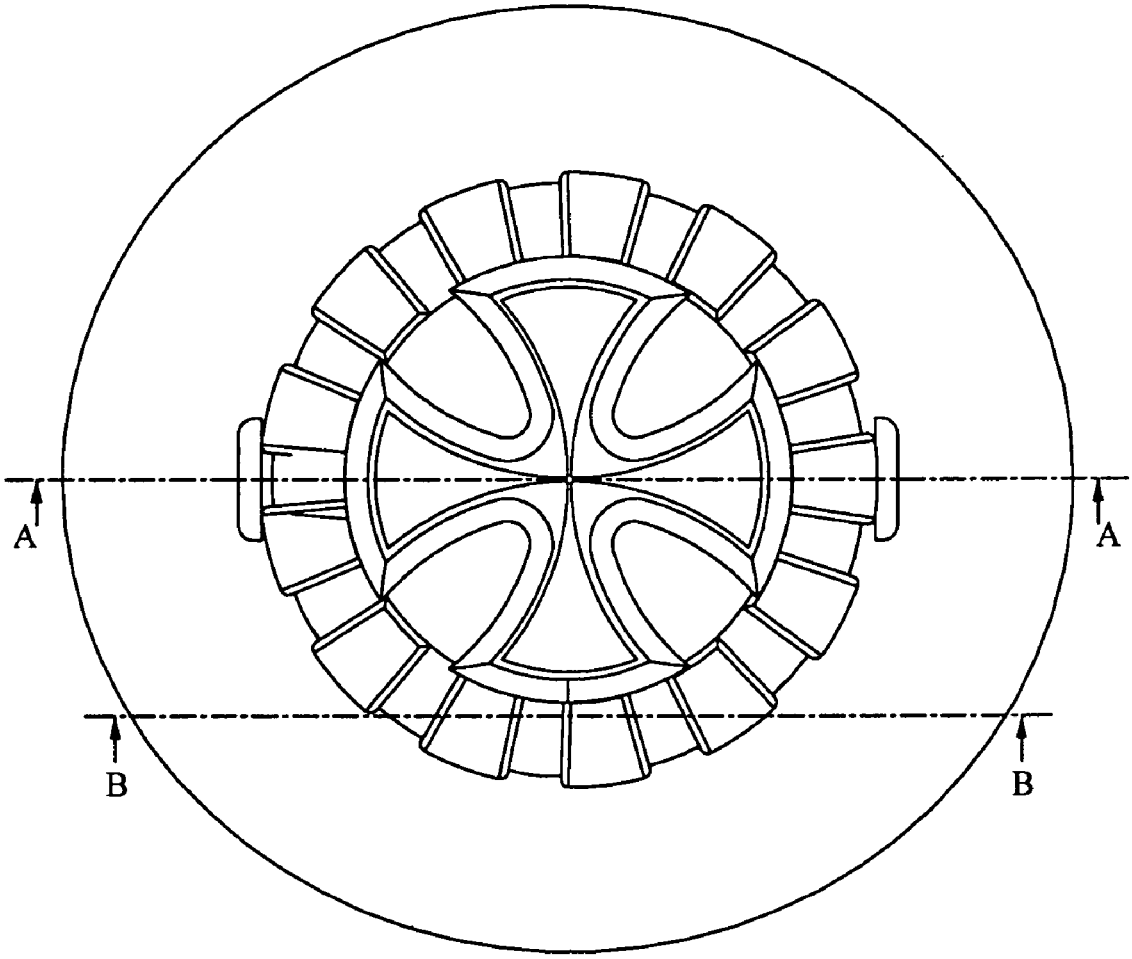
FIG. 11 PRIOR ART
FIG. 11 shows a top view of the first conventional shoelace securing device.
Figure 12:
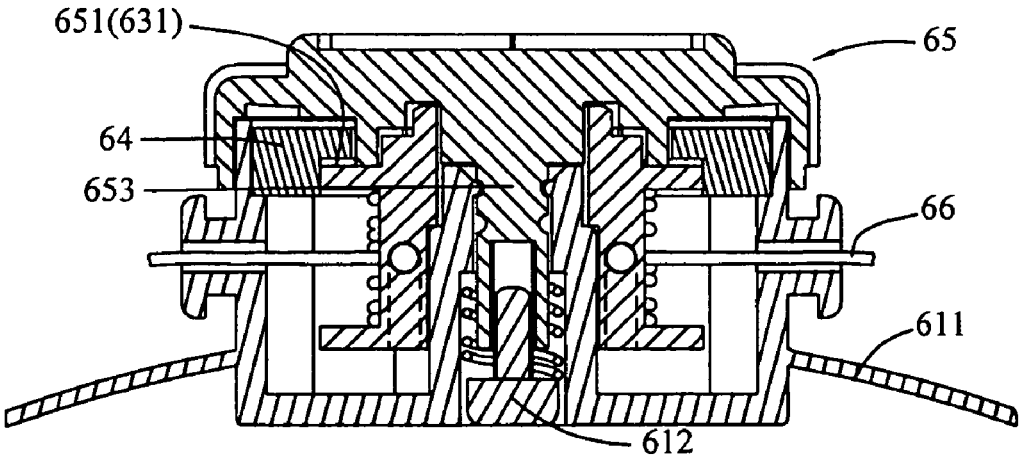
FIG. 12 PRIOR ART
FIG. 12 is a side cross sectional view, taken along line A-A in FIG. 11.
Figure 13:
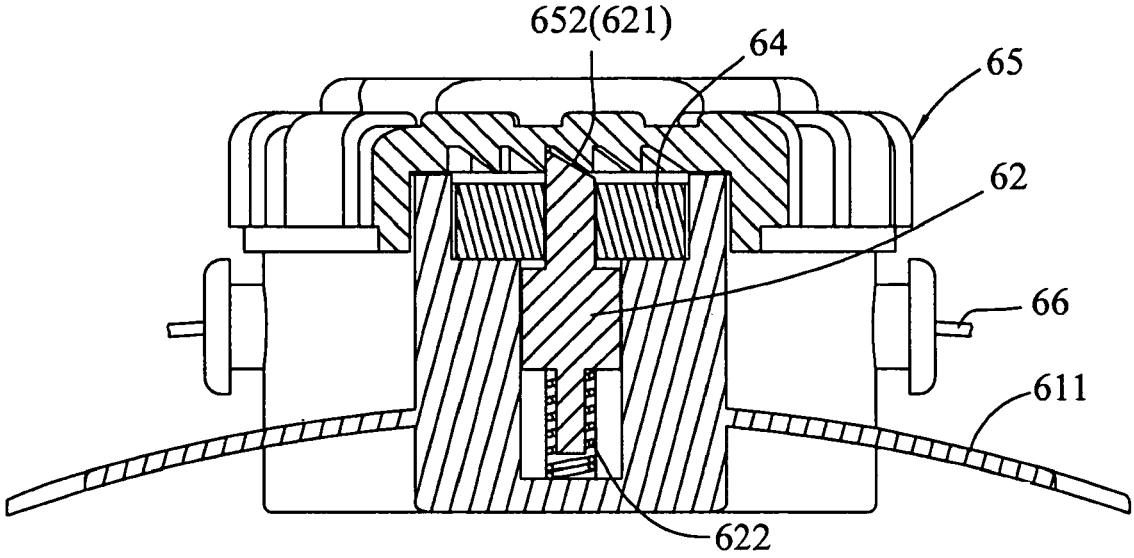
FIG. 13 PRIOR ART
FIG. 13 is a side cross sectional view, taken along line B-B in FIG. 11.
Figure 14:
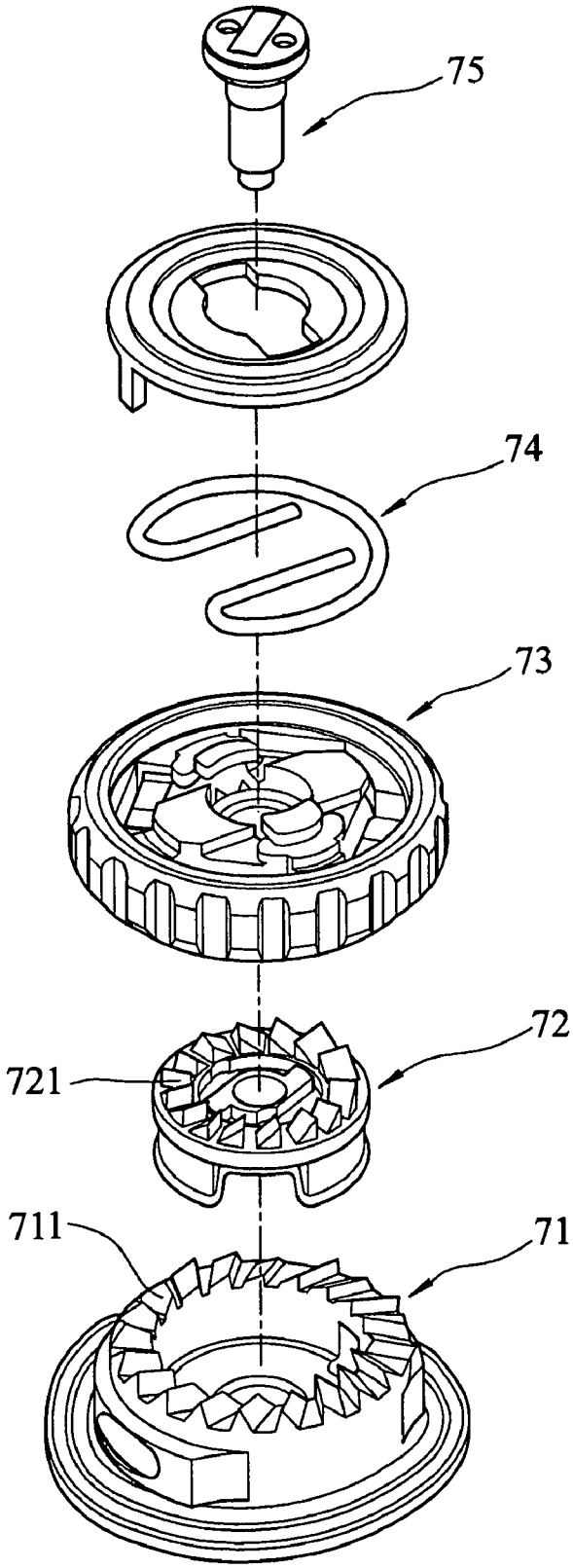
FIG.14 PRIOR ART
FIG. 14 is an exploded view to show a second conventional shoelace securing device.
Figure 15:
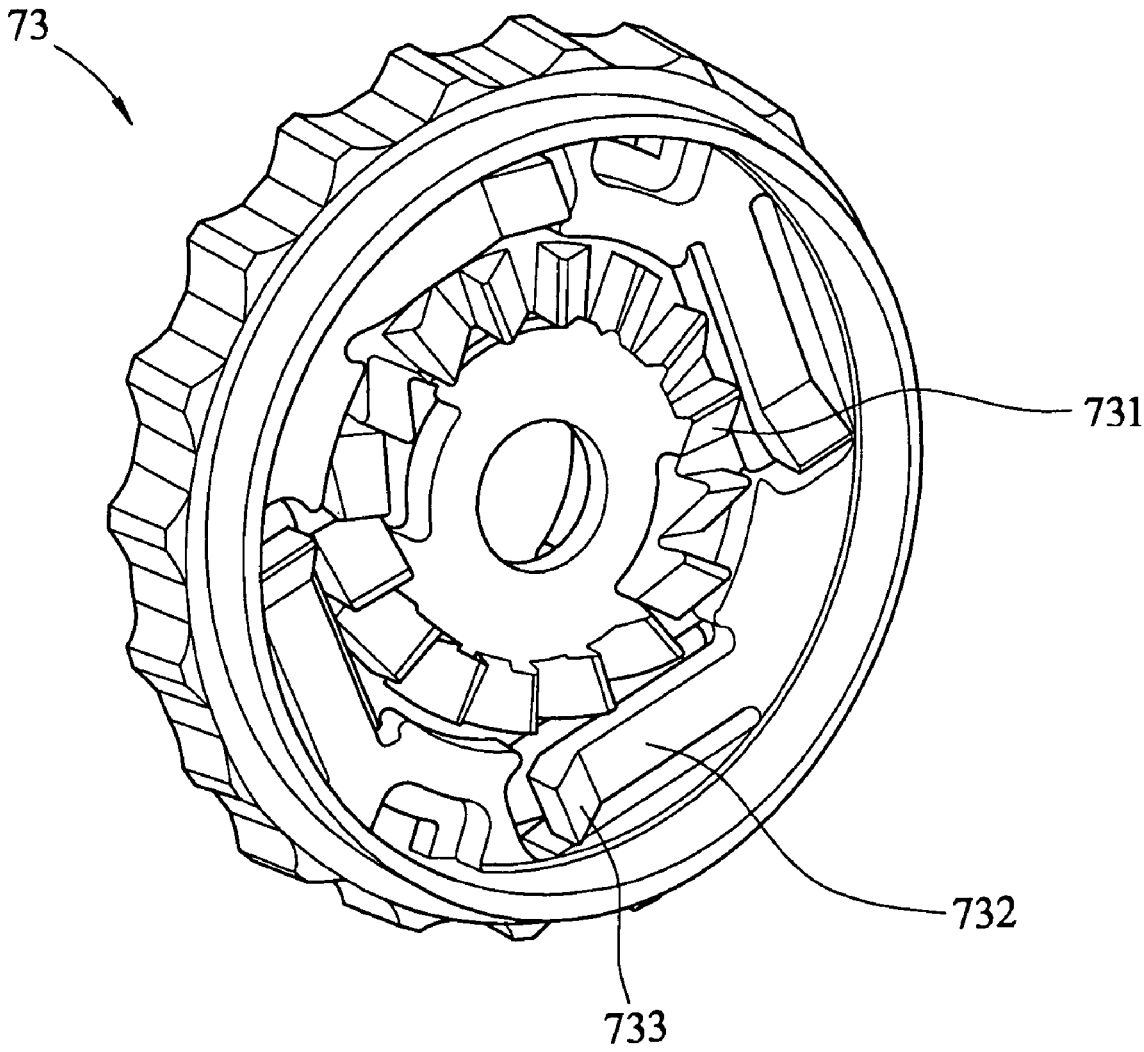
FIG.15 PRIOR ART
FIG. 15 shows the underside of the cap in FIG. 14.

FIGS. 8 and 9 show that a collar 17 may be mounted to the central post 13 to restrict the outward expansion of the plates 132 of the central post 13 and reinforce the clamp force by the plates 132.

The maintenance for the parts between the cap 5 and the base 1 is simple and easy by unscrewing the bolt 53 to access the parts. The flexible members 33 are deformed to store an upward force which effectively engages the ratchet teeth 31 of the ring 3 with the third teeth 55 of the cap 5, such that the operation of the cap 5 is smooth.

It is noted that the securing device can be used for securing fastening straps for helmets, strings for bags, shoelaces for shoes or the like. The string is defined as elongate and flexible member with two ends which are fixed to the spool 4.

While we have shown and described the embodiment in accordance with the present invention, it should be clear to those skilled in the art that further embodiments may be made without departing from the scope of the present invention.

What is claimed is:

1. A string securing device comprising:

a base having a skirt extending from a top thereof and the skirt defining a space, a central post extending centrally from an inner end of the space and having a passage defined axially therethrough;

a shaft extending through the passage of the central post;

a ring having multiple ratchet teeth extending from a top thereof and multiple flexible members connected to an underside of the ring, the ring located within the space defined by the skirt;

a spool having an annular groove and a through hole defined axially through the spool, multiple first teeth extending radially from a top tubular portion of the spool and the spool mounted to the central post, a string connected to the spool, and a cap connected to the shaft and mounted to the base, multiple second teeth defined in an underside of the cap and engaged with the first teeth of the spool, and multiple third teeth defined in the underside of the cap and removably engaged with the ratchet teeth on the ring by a force provided by the flexible members of the ring.

2. The device as claimed in claim 1, wherein multiple blocks extend radially from an outer periphery of the ring and the skirt includes multiple notches with which the blocks are engaged.

3. The device as claimed in claim 1, wherein the cap includes a cover which is mounted to a top of the cap.

4. The device as claimed in claim 1, wherein the spool includes multiple fixing holes and the string are fixed to the fixing holes.

5. The device as claimed in claim 1, wherein the shaft includes a connection end on a top end of the shaft, a first groove and a second groove are defined in an outer periphery thereof, the second groove is located beneath the first groove.

6. The device as claimed in claim 5, wherein the shaft includes a positioning hole defined in the top end thereof and a flange extends radially outward from a bottom end of the shaft.

7. The device as claimed in claim 6, wherein the central post of the base includes multiple plates and multiple axial slits are located between the plates, each plate has a lip extending inward from a top thereof and a stepped shoulder is defined in an inner periphery of the passage, the lips are engaged with one of the first and second grooves, the flange is stopped by the shoulder when the shaft moves within the passage of the central post.

8. The device as claimed in claim 7, wherein a collar is mounted to the central post to restrict the outward expansion of the plates of the central post.

9. The device as claimed in claim 6, wherein the cap includes a central hole and a bolt extends through the central hole from a top of the cap and is connected to the positioning hole of the shaft.

* * * * *